US007909090B2

(12) United States Patent
Reid

(10) Patent No.: US 7,909,090 B2
(45) Date of Patent: Mar. 22, 2011

(54) SYSTEM, METHOD AND APPARATUS FOR SCALE RESISTANT RADIAL BEARING FOR DOWNHOLE ROTATING TOOL COMPONENTS AND ASSEMBLIES

(75) Inventor: Leslie C. Reid, Coweta, OK (US)

(73) Assignee: Baker Hughes Incorporated, Houston, TX (US)

( * ) Notice: Subject to any disclaimer, the term of this patent is extended or adjusted under 35 U.S.C. 154(b) by 302 days.

(21) Appl. No.: 12/186,642

(22) Filed: Aug. 6, 2008

(65) Prior Publication Data

US 2010/0034491 A1 Feb. 11, 2010

(51) Int. Cl.
*E21B 43/00* (2006.01)

(52) U.S. Cl. ..... 166/68; 166/105.5

(58) Field of Classification Search ..... 166/68, 166/105, 105.5

See application file for complete search history.

(56) References Cited

U.S. PATENT DOCUMENTS

| | | | | |
|---|---|---|---|---|
| 4,057,304 | A | 11/1977 | Gaines et al. | |
| 4,410,054 | A | 10/1983 | Nagel et al. | |
| 4,452,307 | A | 6/1984 | Horton | |
| 4,480,703 | A | 11/1984 | Garrett | |
| 4,519,614 | A | 5/1985 | Garner | |
| 4,560,014 | A | 12/1985 | Geczy | |
| 4,796,670 | A | 1/1989 | Russell et al. | |
| 5,189,328 | A | 2/1993 | Knox | |
| 5,209,577 | A * | 5/1993 | Swatek | 384/97 |
| 5,722,812 | A | 3/1998 | Knox et al. | |
| 5,828,149 | A | 10/1998 | Parmeter et al. | |
| 5,845,749 | A | 12/1998 | Moretz et al. | |
| 5,988,996 | A | 11/1999 | Brookbank et al. | |
| 6,068,444 | A * | 5/2000 | Sheth | 415/199.2 |
| 6,099,271 | A | 8/2000 | Brookbank | |
| 6,702,468 | B2 * | 3/2004 | Rennett | 384/296 |
| 6,725,937 | B1 | 4/2004 | McHardy | |
| 6,868,912 | B2 | 3/2005 | Proctor | |
| 6,956,310 | B1 | 10/2005 | Knox | |
| 7,144,549 | B2 | 12/2006 | Adams | |
| 2003/0019665 | A1 | 1/2003 | Horton | |
| 2004/0091352 | A1 * | 5/2004 | Gay et al. | 415/104 |
| 2006/0204359 | A1 | 9/2006 | Semple et al. | |

* cited by examiner

*Primary Examiner* — William P Neuder
(74) *Attorney, Agent, or Firm* — Bracewell & Giuliani LLP

(57) ABSTRACT

Radial bearing designs for electrical submersible pump components and assemblies reduces scale build up on the bearing components. Scale resistant and abrasive resistant sleeves and bushings may be used. The axial lengths of the sleeves are kept within the axial length of the AR bushings, or vice versa, with regard to the axial stroke of one component relative to the other. In addition, sharp corners may be formed on the sleeve or bushing axial faces at their respective interfacing diameters. As the shaft moves axially, the sharp corner on one component scrapes off the scale on the other component. This design discards the scale rather than force it into the clearance between the sleeve and bushing. Small spacer sleeves also may be used adjacent the sleeves so that scale build up on the spacer sleeves is farther away from the bearing to reduce scale-related problems.

19 Claims, 3 Drawing Sheets

SYSTEM, METHOD AND APPARATUS FOR SCALE RESISTANT RADIAL BEARING FOR DOWNHOLE ROTATING TOOL COMPONENTS AND ASSEMBLIES

BACKGROUND OF THE INVENTION

1. Technical Field

The present invention relates in general to radial bearings and, in particular, to a system, method and apparatus for scale resistant radial bearing designs for electrical submersible pump components and assemblies.

2. Description of the Related Art

In many downhole pumping systems, such as rotating equipment like electrical submersible pumps (ESP), gas separators and intakes, the problem of scale build up is observed in the clearances of radial bearings. Scale may include any kind of surface deposit that might tend to develop due to environmental exposure during operation of the equipment. One problem is that the formation of scale impedes the axial movement or stroke of the shaft (i.e., the rotating assembly stack) relative to the stationary support housing. This problem can become critical even when the amount of scale build up is very thin (e.g. on the order of 0.001 inches or more).

Referring to FIG. 1, a conventional radial bearing 11 typically comprise stacked sleeves 13 (one shown) on the shaft 15 where all of the sleeves are formed at the same diameter and engage the bushing 17. For example, some radial bearing bushings and sleeves have a total diameter difference or clearance of about 0.003 to 0.015 inches between their inner and outer diameters, respectively. Scale deposits develop in the clearance on the outer surface of the sleeve that protrudes axially beyond the bushing inner surface. Upon any shaft axial stroke, the scale build up is forced into the tight clearance 19 between the bushing 17 and sleeve 13. As the scale build up is drawn into the clearance, a tremendous frictional drag is introduced in the radial bearing.

A compounding issue for radial bearings is the presence of a chamfer 21 on the face edges of the bushings 17 and sleeves 13. As the shaft 15 is axially stroked, the chamfers 21 on the leading edges act like a funnel or cam to force more scale into the bearing clearance 19. The additional friction due to these issues can cause numerous common failure modes. For example, the bearing and/or sleeve can overheat, the bearing can fail due to loss of lubrication and overheating, and the sleeve can seize inside the bushing.

In addition, the scale can limit the life or prevent reuse of the pump, gas separator or intake due to limited axial shaft stroke or seized shaft. Moreover, the pump can lock up and prevent the motor from starting, and extreme heating can cause motor failure. Furthermore, extreme frictional drag can cause shearing of the key alignment feature that is located under the sleeve, and then continued operation may result in extreme wear and weaken or destroy the shaft. Thus, an improved design that overcomes the limitations and problems associated with prior art designs would be desirable.

SUMMARY OF THE INVENTION

Embodiments of a system, method, and apparatus for reducing scale build up in radial bearing designs for electrical submersible pump (ESP) components and assemblies are disclosed. The invention is well suited for use in downhole rotating equipment such as pumps, gas separators and intakes. For example, scale resistant and abrasive resistant (AR) sleeves and AR bushings (such as PTFE-impregnated, tungsten carbide designs, etc.) may be used in place of conventional materials.

In another embodiment, the axial lengths of the sleeves are kept within the axial length of the bushings, or vice versa, no matter the axial stroke of one component relative to the other. In addition, sharp corners may be formed on the sleeve or bushing axial faces (i.e., at their respective interfacing diameters). As the shaft moves axially, the sharp corner on one component scrapes off the scale on the other component. This design discards the scale rather than force it into the clearance between the sleeve and bushing.

In still another embodiment, smaller diameter, scale resistant spacer sleeves (i.e., on both axial ends of the sleeve) may be used so that scale build up on the spacer sleeves is farther away from the bushing inner diameter and cannot cause a scale-related problem. This design also gives any scale that is scraped away the opportunity to fall away from the bearing. Additional running clearance (e.g., 0.001 inches) between the sleeve and bushing may be added to provide extra lubrication flow and cooling of the components. This element also may be needed for some applications due to the sharp corners on the sleeves or bushings.

The foregoing and other objects and advantages of the present invention will be apparent to those skilled in the art, in view of the following detailed description of the present invention, taken in conjunction with the appended claims and the accompanying drawings.

BRIEF DESCRIPTION OF THE DRAWINGS

So that the manner in which the features and advantages of the present invention are attained and can be understood in more detail, a more particular description of the invention briefly summarized above may be had by reference to the embodiments thereof that are illustrated in the appended drawings. However, the drawings illustrate only some embodiments of the invention and therefore are not to be considered limiting of its scope as the invention may admit to other equally effective embodiments.

DETAILED DESCRIPTION OF THE INVENTION

Referring to FIGS. 2-6, embodiments of a system, method and apparatus for reducing scale build up in radial bearings for downhole tools are disclosed. The invention is well suited for downhole rotating equipment, such as electrical submersible pump (ESP) assembly components (e.g., pumps, gas separators, intakes, etc.).

Figure 2:
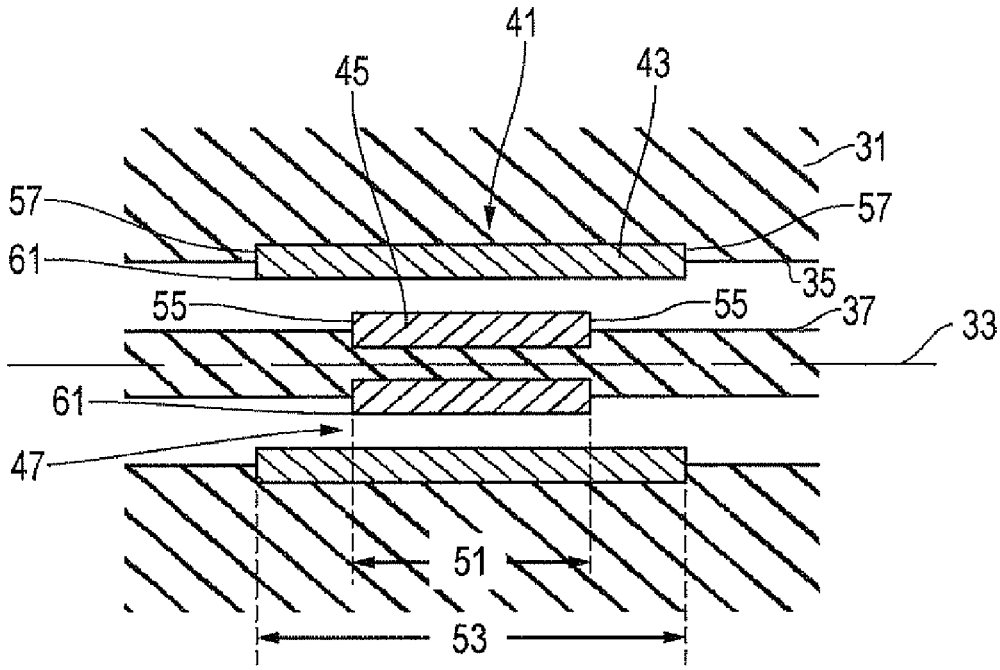
FIG. 2 is a schematic sectional side view of one embodiment of a radial bearing installation constructed in accordance with the invention.

One embodiment of the invention is shown in FIG. 2. The downhole tool has a housing 31 with an axis 33 and a hole 35 extending through the housing 31 along the axis 33. A shaft 37 is located in and extends through the hole 35 in the housing 31 along the axis 33. The shaft 37 is rotatable relative to the housing 31 and has a limited range of axial motion, depending on the application and installation.

A radial bearing 41 is installed in the downhole tool for reducing scale build up. The radial bearing 41 is located in the hole 35 of the housing 31 for supporting the shaft 37 relative to the housing 31. The radial bearing 41 comprises a bushing 43 mounted to the housing 31, and a sleeve 45 mounted to the shaft 37 for engaging the bushing 43. The sleeve 45 moves rotationally and axially with the shaft 37 relative to the housing 31 and bushing 43. A clearance 47 is located between an inner diameter of the bushing 43 and an outer diameter of the sleeve 45.

Figure 3:
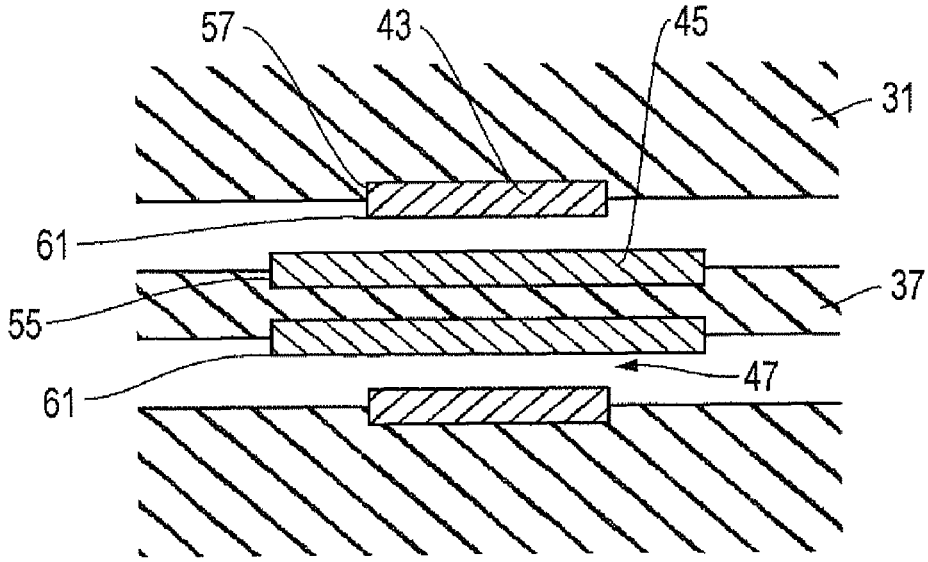
FIG. 3 is a schematic sectional side view of another embodiment of a radial bearing installation constructed in accordance with the invention.

In the embodiment shown in FIG. 2, the sleeve 45 has a short axial length 51 and the bushing 43 has a long axial length 53 that is greater than the short axial length 51. As such, the axial ends 55 of the short axial length 51 of the sleeve 45 never extend axially beyond the axial ends 57 of the long axial length 53 of the bushing 43 throughout the limited range of axial motion of the shaft 37. FIG. 3 depicts an alternate embodiment wherein the sleeve 45 is axially longer than the bushing 43. Similarly, the axial ends 57 of the bushing 43 never extend axially beyond the axial ends 55 of the sleeve 45 throughout the limited range of axial motion of the shaft 37.

In some embodiments, the bushing 43 and the sleeve 45 are formed from scale resistant and abrasive resistant materials. For example, the bushing 43 and sleeve 45 may be formed from PTFE-impregnated, tungsten carbide. Alternatively, these components may be coated, impregnated or otherwise formed from other types of scale and abrasive resistant materials.

Figure 6:
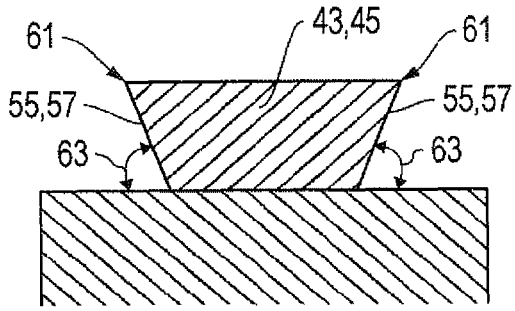
FIG. 6 is an enlarged side view of one embodiment of a "sharp edge" for one or more of the radial bearing installations disclosed herein.

In other embodiments, the bushing 43, the sleeve 45 or both may be provided with a sharp corner(s) 61 (schematically depicted in FIG. 6) on an axial end(s) 57, 55, respectively, thereof. In FIG. 6, the features are exaggerated for clarity. Sharp corners 61 may be provided on one or both axial ends of the component to scrape scale off of the other component of the radial bearing (i.e., the bushing scrapes the sleeve, and/or the sleeve scrapes the bushing) at their respective interfacing diameters.

This design helps to remove and discard the scale rather than force it into the clearance 47 between the bushing 43 and sleeve 45. For example, corner 61 may be provided with a maximum radius of 0.005 inches, and employ a face angle 63 of less than 90° as shown (e.g., 85° to 89°). The face angle 63 enhances the scraping action and extends the life of the sharp corner in the event of surface wear. With an angle of less than 90°, the scraping corner is "self sharpening" as surface wear progresses, prolonging the scale-resistance of the design.

Figure 1:
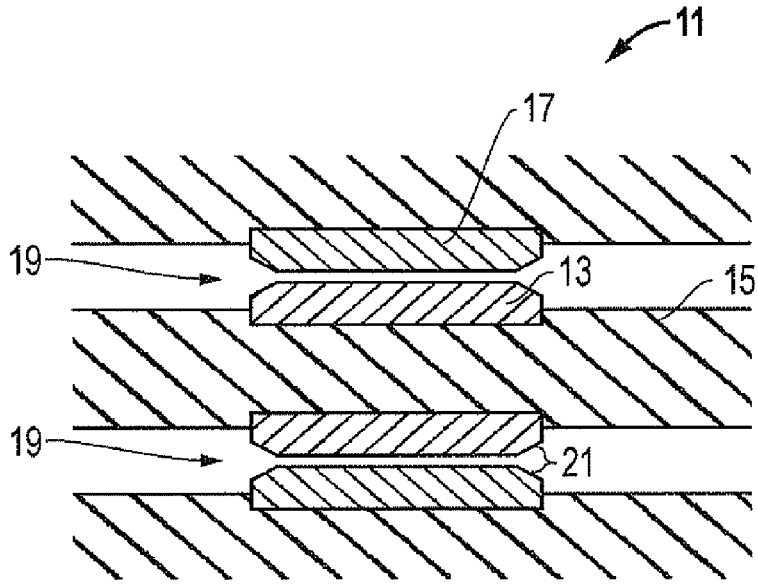
FIG. 1 (Prior Art)
FIG. 1 is a schematic sectional side view of a conventional radial bearing installation.
Figure 4:
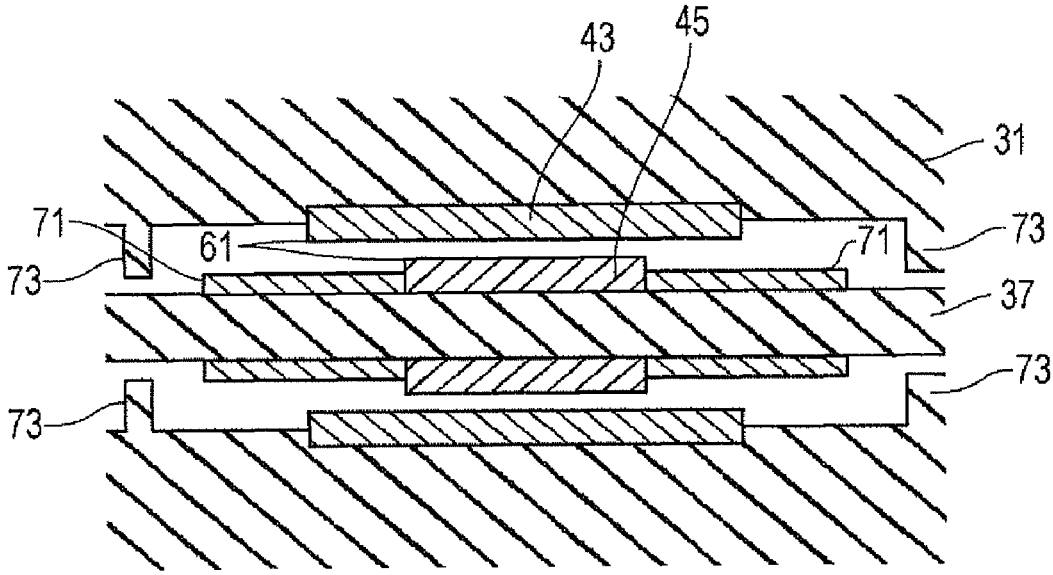
FIG. 4 is a schematic sectional side view of still another embodiment of a radial bearing installation constructed in accordance with the invention.

Referring now to FIG. 4, the invention may further comprise smaller diameter, scale resistant spacer sleeves 71 located on and abutting axial ends 55 of the sleeve 45. The spacer sleeves 71 provide mechanical limits to ensure that the bearing sleeve is located in the correct axial position on the shaft. Retaining rings 73 or other mechanical features also may be used on the shaft to keep the spacer sleeves 71 in the correct axial positions. In some embodiments, the hubs of pump impellers provide and act to keep the spacer sleeves in the correct axial position. Each of these axial stroke limiters, may be employed for the various other embodiments depicted and described herein (e.g., FIGS. 1-3).

Additional running clearance (e.g., 0.001 inches) between the sleeve and bushing also may be added to provide extra lubrication flow and cooling of the components. This element also may be needed for some applications due to the sharp corners on the sleeves or bushings.

Figure 5:
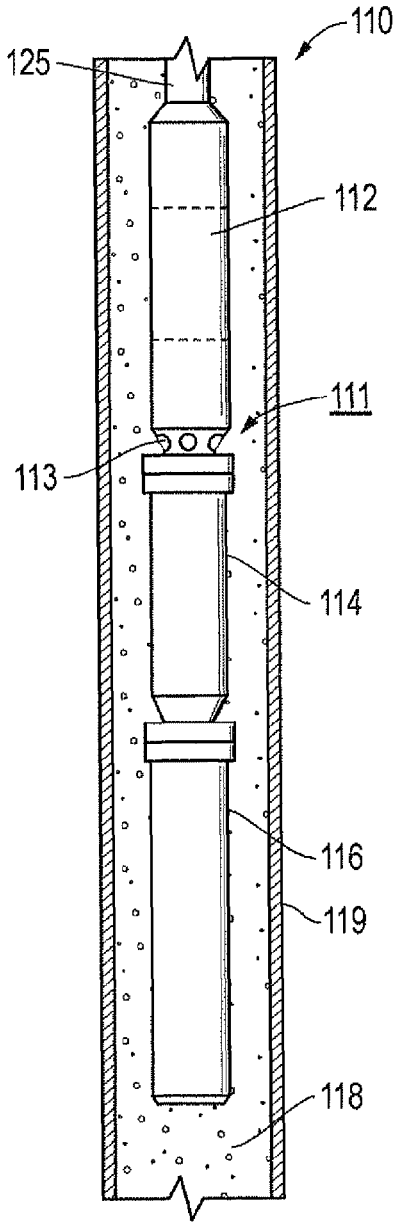
FIG. 5 is a schematic side view of one embodiment of a downhole rotating tool constructed in accordance with the invention.

Referring now to FIG. 5, one embodiment of a downhole tool for a well 110 is shown. The downhole tool comprises an electrical submersible pump (ESP) assembly 111 installed within the well 110. The pump assembly 111 may comprise a centrifugal pump 112 with an intake 113 and an internal gas separator. A seal section 114 is attached to pump 112 and to an electric motor 116 and submerged in a well fluid 118. The motor 116 has a shaft that connects to the seal section shaft and is connected to the shaft in the centrifugal pump 112. The pump assembly 111 and well fluid 118 are located within a casing 119, which is part of the well 110. Pump 112 connects to tubing 125 that conveys the well fluid 118 to a storage tank (not shown). The radial bearing designs disclosed herein may be employed in the pump, gas separator, intake or still other components that are suitable for downhole applications.

While the invention has been shown or described in only some of its forms, it should be apparent to those skilled in the art that it is not so limited, but is susceptible to various changes without departing from the scope of the invention. For example, a chamfer may be formed on corner(s) of the longer component of the bushing or sleeve so as to allow the longer component to be inserted more easily into the bushing bore. However, the components are prevented from sliding under the chamfers under any thermal expansion condition or shaft stroke mechanical limits.

What is claimed is:

1. A downhole tool, comprising:

a housing having an axis and a hole extending through the housing along the axis;

a shaft located in and extending through the hole in the housing along the axis, the shaft being rotatable relative to the housing and having a limited range of axial motion;

a radial bearing for reducing scale build up, the radial bearing being located in the hole of the housing for supporting the shaft relative to the housing, the radial bearing having a bushing mounted to the housing, a sleeve mounted to the shaft for engaging the bushing and rotation and axial motion with the shaft relative to the housing and bushing, and a clearance located between an inner diameter of the bushing and an outer diameter of the sleeve;

spacer sleeves located on and abutting the axial ends of the sleeve as mechanical limits to maintain the bearing sleeve in a correct axial position on the shaft, the spacer sleeves having a smaller diameter than the sleeve and being formed from scale resistant material; wherein one of the bushing and the sleeve has a short axial length and the other of the bushing and the sleeve has a long axial length that is greater than the short axial length, such that axial ends of the short axial length never extend axially beyond axial ends of the long axial length throughout the limited range of axial motion.

2. A downhole tool according to claim 1, wherein the downhole tool is an electrical submersible pump (ESP) assembly component.

3. A downhole tool according to claim 2, wherein the ESP assembly component is one of a pump, a gas separator and an intake.

4. A downhole tool according to claim 1, wherein the bushing and the sleeve are formed from scale resistant and abrasive resistant materials.

5. A downhole tool according to claim 4, wherein the bushing and sleeve are formed from PTFE-impregnated, tungsten carbide.

6. A downhole tool according to claim 1, wherein said one of the bushing and the sleeve is provided with a sharp corner on an axial end thereof for scraping scale off of the other of the bushing and the sleeve at their respective interfacing diameters to discard the scale rather than force it into the clearance between the bushing and sleeve.

7. A downhole tool according to claim 6, wherein the sharp corner comprises a maximum radius of 0.005 inches, and employ a face angle 63 of less than 90°.

8. A downhole tool according to claim 6, wherein both axial ends of said one of the bushing and the sleeve are provided with the sharp corner.

9. A downhole tool according to claim 6, wherein both the bushing and the sleeve are provided with the sharp corner.

10. A downhole tool according to claim 1 wherein one of retaining rings and hubs of pump impellers act to keep the spacer sleeves in the correct axial position.

11. A downhole tool, comprising:

a housing having an axis and a hole extending through the housing along the axis;

a shaft located in and extending through the hole in the housing along the axis, the shaft being rotatable relative to the housing and having a limited range of axial motion;

a radial bearing for reducing scale build up, the radial bearing being located in the hole of the housing for supporting the shaft relative to the housing, the radial bearing having a bushing mounted to the housing, a sleeve mounted to the shaft for engaging the bushing and rotation and axial motion with the shaft relative to the housing and bushing, and a clearance located between an inner diameter of the bushing and an outer diameter of the sleeve;

one of the bushing and the sleeve has a short axial length and the other of the bushing and the sleeve has a long axial length that is greater than the short axial length, such that axial ends of the short axial length never extend axially beyond axial ends of the long axial length throughout the limited range of axial motion; and said one of the bushing and the sleeve is provided with a sharp corner on an axial end thereof for scraping scale off of the other of the bushing and the sleeve at their respective interfacing diameters to discard the scale rather than force it into the clearance between the bushing and sleeve.

12. A downhole tool according to claim 11, wherein the downhole tool is an electrical submersible pump (ESP) assembly component comprising one of a pump, a gas separator and an intake.

13. A downhole tool according to claim 11, wherein the bushing and the sleeve are formed from scale resistant and abrasive resistant materials.

14. A downhole tool according to claim 13, wherein the bushing and sleeve are formed from PTFE-impregnated, tungsten carbide.

15. A downhole tool according to claim 11, wherein the sharp corner comprises a maximum radius of 0.005 inches, and employ a face angle 63 of less than 90°.

16. A downhole tool according to claim 11, wherein both axial ends of said one of the bushing and the sleeve are provided with the sharp corner.

17. A downhole tool according to claim 11, wherein both the bushing and the sleeve are provided with the sharp corner.

18. A downhole tool according to claim 11, further comprising spacer sleeves located on and abutting the, axial ends of the sleeve as mechanical limits to maintain the bearing sleeve in a correct axial position on the shaft, the spacer sleeves having a smaller diameter than the sleeve and being formed from scale resistant material.

19. A downhole tool according to claim 18, wherein one of retaining rings and hubs of pump impellers act to keep the spacer sleeves in the correct axial position.

* * * * *

UNITED STATES PATENT AND TRADEMARK OFFICE

CERTIFICATE OF CORRECTION

PATENT NO. : 7,909,090 B2
APPLICATION NO. : 12/186642
DATED : March 22, 2011
INVENTOR(S) : Leslie C. Reid It is certified that error appears in the above-identified patent and that said Letters Patent is hereby corrected as shown below:

COVER PAGE ITEM:

(73) Assignee: delete "Baker Hugbes Incorporated, Houston,"
and insert --Baker Hughes Incorporated, Houston,--

Signed and Sealed this
Seventeenth Day of May, 2011

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,909,090 B2
APPLICATION NO. : 12/186642
DATED : March 22, 2011
INVENTOR(S) : Leslie C. Reid It is certified that error appears in the above-identified patent and that said Letters Patent is hereby corrected as shown below:

Column 5, line 12, delete “employ” and insert --employs--
Column 6, line 30, delete “the,” and insert --the--

Signed and Sealed this
Twenty-first Day of June, 2011

David J. Kappos

David J. Kappos
*Director of the United States Patent and Trademark Office*